US005275290A

United States Patent [19]

Bierfreund

[11] Patent Number: 5,275,290

[45] Date of Patent: Jan. 4, 1994

[54] DIMENSIONALLY FIRM TRANSPORT BOX

[75] Inventor: Karl-Heinz Bierfreund, Ober-Ramstadt, Fed. Rep. of Germany

[73] Assignee: Air Box Concept GmbH, Ober-Ramstadt, Fed. Rep. of Germany

[21] Appl. No.: 847,734

[22] Filed: Mar. 9, 1992

[30] Foreign Application Priority Data

Jul. 31, 1991 [DE] Fed. Rep. of Germany ... 9109459[U]
Jan. 11, 1992 [DE] Fed. Rep. of Germany ..... 4200557

[51] Int. Cl.[5] ..... B65D 81/02
[52] U.S. Cl. ..... 206/522; 220/445
[58] Field of Search ..... 206/320, 521, 522; 220/464, 468, 445

[56] References Cited

U.S. PATENT DOCUMENTS

| | | | |
|---|---|---|---|
| 3,733,005 | 5/1973 | Frieder, Jr. | 206/522 |
| 3,889,743 | 6/1975 | Presnick | 206/522 |
| 4,591,519 | 5/1986 | Liebel | 206/522 |
| 4,684,026 | 8/1987 | Takeuchi et al. | 206/522 |
| 4,762,231 | 8/1988 | Kiselewski | 206/522 |
| 4,801,213 | 1/1989 | Frey | 206/522 |
| 4,905,835 | 3/1990 | Pivert | 206/522 |

FOREIGN PATENT DOCUMENTS

| | | |
|---|---|---|
| 1831966 | 3/1961 | Fed. Rep. of Germany . . |
| 848248 | 9/1960 | United Kingdom . |

*Primary Examiner*—Jimmy G. Foster
*Attorney, Agent, or Firm*—Jacobson, Price, Holman & Stern

[57] ABSTRACT

Disclosed is a dimensionally firm transport box, particularly container, which has firm and substantially plane side walls and a bottom wall and a cover. Each side wall is made from a two shell construction according to which spacer elements are arranged between the two shells of each side wall so as to mount the inner shell to the outer shell in spaced relationship. The spacer elements and/or the inner shell may have sufficient elasticity to withstand an increase of pressure of gas by which an air bag mounted to the inner shells may be inflated. The air bag is divided into communicating compartments which are associated to the side walls. A filling valve for the air bag is disclosed which has security features for preventing unauthorized use. Specific cooperating profiles are provided for removably mounting each compartment to its associated inner shell.

22 Claims, 4 Drawing Sheets

DIMENSIONALLY FIRM TRANSPORT BOX

FIELD OF INVENTION

The invention refers to a dimensionally firm transport box, particularly container, which has firm and substantially plane side walls and a bottom wall and a cover. Such a box or container is adapted to store and protect a structured sensitive product to be shipped to a distant destination.

British Patent Specification 848 248 discloses a container which is made from a protective carton or wood and into which an inflatable air bag may be inserted. The airbag comprises of a plurality of communicating compartments. The dimensions of the compartments correspond to the extensions of the side walls, the bottom wall and the cover of the container. The air bag is provided with a valve projecting through a side wall of the container for inflating or deflating the compartments. For packing a structured product, the air bag is inserted into the container and the compartments thereof are inflated such that the inner webs of the compartments contact the product thereby holding the product within the container safely and without any risk of damage during shipping of the container.

German Utility Model Specification 1,831,966 discloses a container the walls of which comprise a number of webs of plastic material. The space between adjacent webs may be inflated. The charging hole of the container is defined by a rigid frame to which the plastic webs are fastened. The innermost plastic web may be deformed elastically by pressurized air into the interior of the container such that innermost web contacts the product put into the container for shipping.

For safely holding and bearing the product to be shipped the air bag and its compartments have to be inflated to a sufficient air pressure. Such containers have the inherent drawback that the pressure of air included within the bag varies with changing temperature conditions. When the temperature outside the container rises substantially, the air pressure increases to the effect that the air bag either damages the product or causes outward bending of the container walls. On the other hand, decreasing temperatures cause a decreasing air pressure within the air bag to the effect that the product is not safely held within the container.

OBJECT OF THE INVENTION

It is therefore an object underlying the invention to provide an improved container for shipping an article particularly a product which is sensitive to shock for shipping. Moreover, it is yet another object of the invention to devise a container having an inflatable air bag the container walls of which will not substantially bend outwards when the ambient temperature is rising.

SUMMARY OF THE INVENTION

According to the invention the transport box or container has firm and substantially plane side walls and a bottom and a cover which may be removable or hinged to one of the side walls. Each side wall is made from a two shell construction. Spacer elements are arranged between the two shells of each side wall so as to mount the inner shell to the outer shell in spaced relationship. According to one embodiment of the invention, each inner shell is made of a material which allows the inner shell to bend elastically outwardly in the event a force is applied thereto transversely to the main surface of the inner shell. The spacers may then be made from comparatively hard material. In the alternative, the inner shell may be made as a stiff panel and the spacers may elastically yield under the influence of said force.

While the inner surface of the cover and the bottom wall may be lined with any shock absorbing elastic cushions, an improvement of the invention provides for a two shell construction of the cover and the bottom wall as well as explained above for the side walls.

According to the invention of inflatable air bag is provided which comprises a number of communicating compartments corresponding to the number and dimensions of the side walls of the box. Each compartment is fastened to the inner shell of a side wall. Specifically, a separate air bag may be bonded to the inner shell of the cover. Another air bag may be bonded to the inner shell of the bottom. Preferably, the air bag mounted to the bottom may communicate with the compartments of the air bag fastened to the side walls.

According to an embodiment of the invention, the distance elements or spacers may be made from elastic plastic material or rubber and the inner shell may then be made as firm plastic or metal board without substantial elasticity transversely to the main surface thereof. In an alternative embodiment of the invention, the spacers may be stiff whereas the inner shell then may be made from elastic board of thin plastic material or plywood or thin metal sheet. In this embodiment of the invention, the spaces should be arranged in proximity to the edges of the box for allowing the inner shell to yield elastically under the influence of a higher air pressure within the associated compartment.

According to an embodiment of the invention the compartments of the air bag may be mounted detachably to the inner shell, for example by a plurality of Velcro-fasteners. In the event that the air bag will become damaged during shipping, it can be detached easily from the container and be replaced by a new bag. According to an improvement of the invention, the compartments may communicate through detachable hoses, which connect one compartment to the adjacent compartments. Specifically, the air bag of the cover may communicate with the compartments associated to the side walls and the bottom of the container through a connecting hose.

According to a still further preferred embodiment of the invention each compartment is hung into a unique profile of the inner shell of the associated container side wall. Specifically, an elongated rubber web is bonded to the top of a compartment which is formed to a rubber cord along its free end. The rubber cord is detachably trapped within a channel profile fastened along the upper edge of the inner shell board.

Last but not least, the air bag is provided with a specific valve for filling and discharging air which has safety features preventing filling of air by unauthorized means.

DESCRIPTION OF A PREFERRED EMBODIMENT OF THE INVENTION

Figure 1:
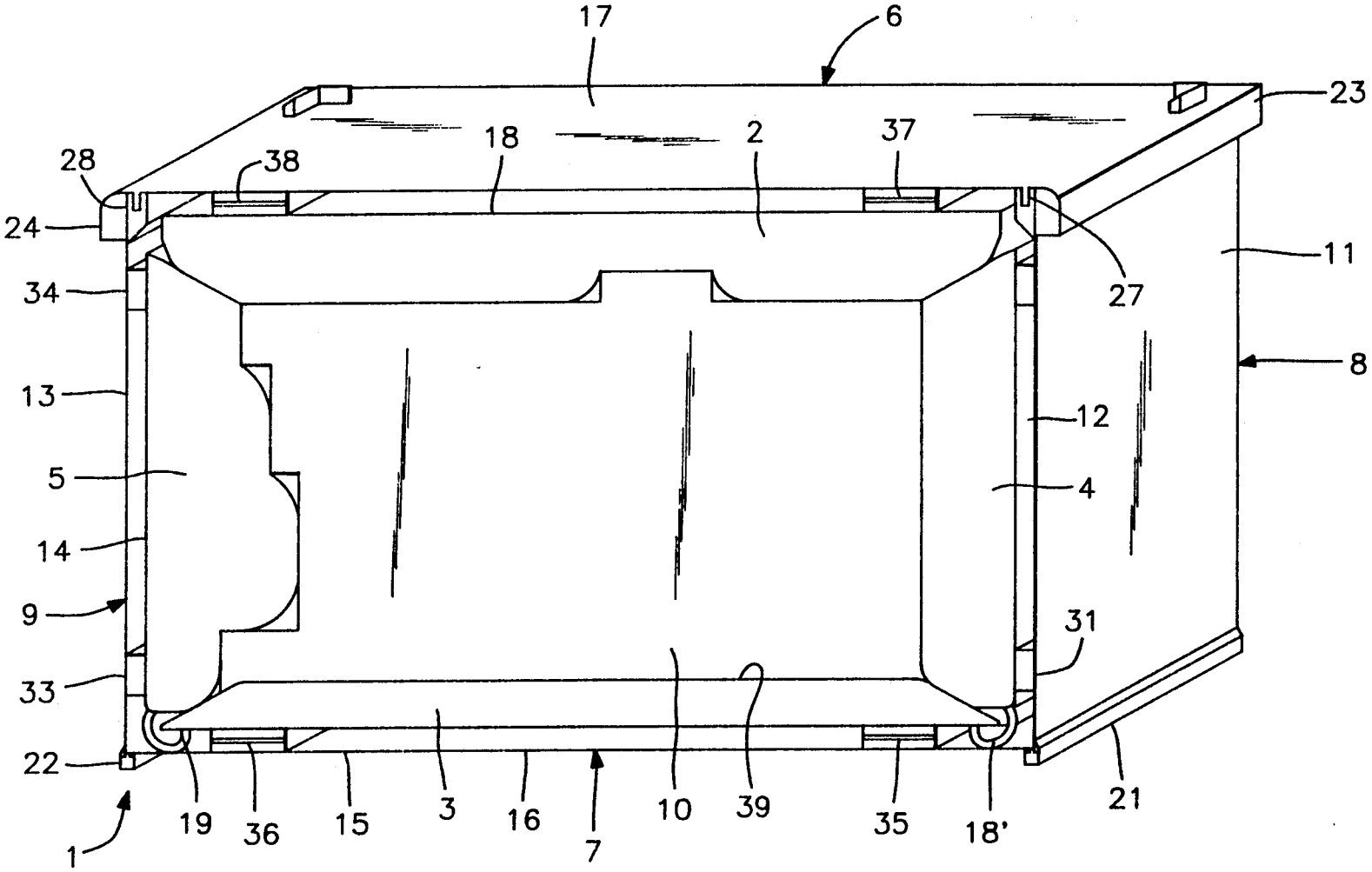
FIG. 1 shows schematically a vertical section through a container for shipping a sensitive product.

The rectangular container 1 shown in FIG. 1 has two opposing parallel side walls 8, 9, a bottom wall 7 and a cover 6 which is detachable from the side walls and may close the feed opening surrounded by the side walls. The side walls 8, 9 are fastened to the other two, in FIG. 1 not shown transverse side walls and to the bottom 7. The lower edges of side walls 8 and 9 are fastened to lower transverse bars 21, 22. The cover has upper transverse bars 23, 24 which overlap the side walls. Side walls 8, 9, cover 6 and bottom 7 are generally plane but may be reinforced by not-shown outwardly extending beads. The upper transverse bars 23, 24 are each provided with a fixing device 27, 28 of known type for removably locking the cover 6 to the side walls 8, 9.

The side walls 8, 9 and the not-shown front wall and back wall, bottom 7 and cover 6 are made each of a two-shell construction. For example, side wall 8 has an outer shell 11 made of wood, sheet steel or light sheet metal plate, and an inner shell 12 made of a plane plywood or plastic board. Spacers 31, 32 are placed between outer shell 11 and inner shell 12, which consist of elastic foam rubber or the like and which are bonded to the inside of outer shell 11 and to the outside of inner shell 12 by a suitable adhesive. In the preferred embodiment of the invention the spacer 31 is a strip which runs parallel and close to the lower transverse bar 21 whereas spacer 32 is a strip which runs parallel and close to upper transverse bar 23. The distance between spacers 31, 32 and the thickness of inner shell 12 allows the inner shell to bend upon pressure towards the outer shell 11 into the space between the two spacers 31, 32. This quality of the inner shell 12 is most important in case spacers 31, 32 are not compressable, e.g. when made of metal. If spacers 31, 32 are made of elastic material, inner shell 12 may be thicker because the spacers will elastically resume part of the said pressure. So the spacers may consist of square or round rubber buffers which are arranged throughout the extensions of the inner shell.

Side wall 9, cover 6, bottom 7 and the two not-shown side walls have the same structure as side wall 9 described above. Side wall 9 consists of outer shell 13 and inner shell 14 with spacers 33, 34 between them. Similarly, bottom 7 comprises an outer shell 15 and an inner shell 16 and intermediate spacers 35, 36. Also the cover 6 has an outer shell 17 and an inner shell 18, which is held in spaced relationship to the outer shell 17 by two spacers 37, 38.

An air bag is mounted in the interior of the container which is divided in a number of compartments. The air bag consists of a rubberlike web which will elastically expand when being inflated by pressurized air or a similar gas. Each of the compartments is associated to one of the container walls and has dimensions substantially equal to the length and width of the associated wall. As shown in FIG. 1 the inner webs of compartments 3, 4, 5 are bonded by an adhesive or by not shown Velcro fasteners to the inner surfaces of inner shells 12, 14, 16. The outer webs of the compartments which are exposed to the interior of the container are reinforced by a wear resistant coating. Hoses 18', 19 are provided for connecting compartments 4 and 3 and compartments 3 and 5, respectively.

One of the compartments, say compartment 5, is equipped with a filling valve for filling in pressurized air from a not-shown pressurized air source into the communicating compartments. The filling valve when closed prevents the air from escaping out of the compartments and, when opposed allows to release the compartments from pressurized air which may vent through the filling valve.

As shown specifically in FIGS. 4 through 8, the axially board valve body 40 comprises a female main body 42. The main body 42 has a radially extended and outwardly knurled bottom 46 opposite to the opening of the main body 42. The bottom 46 has a central bore, which continues to the interior of a tube 44 formed as an integral portion of the main body 42 and extending opposite to the opening of the main body 42. The central bore of bottom 46 inside the cuplike opening of the main body 42 is surrounded by an O-ring 50 which is accommodated within an inner radial extension 48 of the main body 42. The inner surface of the cupsection of the main body 42 adjacent the radial extension 48 thereof is provided with an inner thread 52 of very small lead. The diameter of the thread 52 is greater than the outer diameter of O-ring 50.

The cylindric male body 60 comprises a main portion 62 which has an axial bore, and a head 66 which closes the axial bore of the main portion 62 in axial direction. The head 66 is connected to a section 72 of the main portion 62 by an transitional section 64 of substantially reduced outer diameter. Opposing cross bores 68, 70 penetrate the wall of transition section 64 to communicate with the axial bore of the male body 60. The cylindric outer surface of portion 72 is provided with an external thread of same lead as the internal thread 52. From portion 72 extends radially a ring 74 at the end of the outer thread opposite to the head 66. The outer surface of ring 79 is knurled. The portion 72 continues beyond ring 74 to a mouth portion 76 of the male body 60. The central bore of male body 60 has an inner radial extension 82 which accomodates an O-ring 84. Two axially extending and opposite grooves 78, 80 ar cut into the outer periphery of mouth portion 76 and into ring 74. Grooves 78, 80 terminate before the beginning of the external thread on the periphery of portion 72.

The filling valve may be assembled by screwing in clockwise direction the male portion 60 into the female portion 42 such that the external thread on portion 42 engages the internal thread 52. The male portion 60 may be turned into the female portion 42 until the end surface of head 66 abuts O-ring 50 in sealing condition. The central bore of male portion 30 is then shut off from the interior of the central bore of ring 46 and of tube 44. In this condition, the filling valve is closed and may easily withstand an air pressure within the compartments 3, 4, 5 of approximately 0.6 bar. The sealing function of the filling valve is supported by the small lead of threads 52 and upon section 72.

For opening the valve, the male body 60 has to be turned in counter-clockwise direction to the effect that the end-surface of head 66 is released from engagement to the O-ring 50. In this condition, the axial bore of male portion 60 communicates with the interior of tube 44 through the opposing bores 68, 70 in the transitional section 64 and a channel formed around head 66 and between the end surface thereof and the O-ring 50. It is to be understood that the internal diameter of the cup portion of body 42 is slightly greater than the outer diameter of head 66.

For filling purposes a unique cap 90 is provided by the invention which has a cup portion 92 from the bottom of which extends a tube portion 96. The inner diameter of cup section 92 matches with the outer diameter of mouth portion 76. The axial depth of cup portion 92 corresponds to the axial length of mouth portion 76. Cup portion 92 has a central extension 94 of tube 96 the free ends of which are formed conically. If the cylindrical cup portion 92 is maneuvered onto mouth portion 76 so that the free end of cup portion 92 abuts the opposing surface of ring 74 (FIGS. 4, 5) the conical ends of the extension 94 engage sealingly the O-ring 84. The interior of tube section 96 then communicates with the central bore of male body 60 without risk of leakage of pressurized air.

The female body 42 may be formed as a one-piece metal part, and the male body 60 similarly may be formed as a one-piece metal part. On the other hand, cap 90 may consist of a plastic material for easing the coupling thereof to the mouth portion 76 of male body 60.

A plastic fitting 100 is bonded to the outer skin 102' of compartment 5 in an edge area thereof where it does not impair the holding function of the compartments. Fitting 100 has a central bore 102 communicating with the interior of compartment 5. The bore 102 has a width such that tube 44 may be easily and sealingly inserted into bore 102.

For filling the compartments with pressurized air, tube section 96 has to be coupled by a suitable hose to a source of pressurized air. When the filling valve is opened, pressurized air may be filled into the compartments.

In the event it should be intended to fill in pressurized air by unauthorized means instead of cap 90, say simply by a hose of suitable internal diameter, such hose will have to be maneuvered over mouth portion 76. The grooves 78, 80 then maintain a communication between the exterior of the valve and the interior of the hose to the effect that the pressurized air will escape from the hose and filling of the compartments even when filling valve is open will not be possible. This is a important safety feature of the filling valve which guarantees that the compartments are filled with pressurized air of admitted pressure of approximately 0.6 bar.

Figure 2:
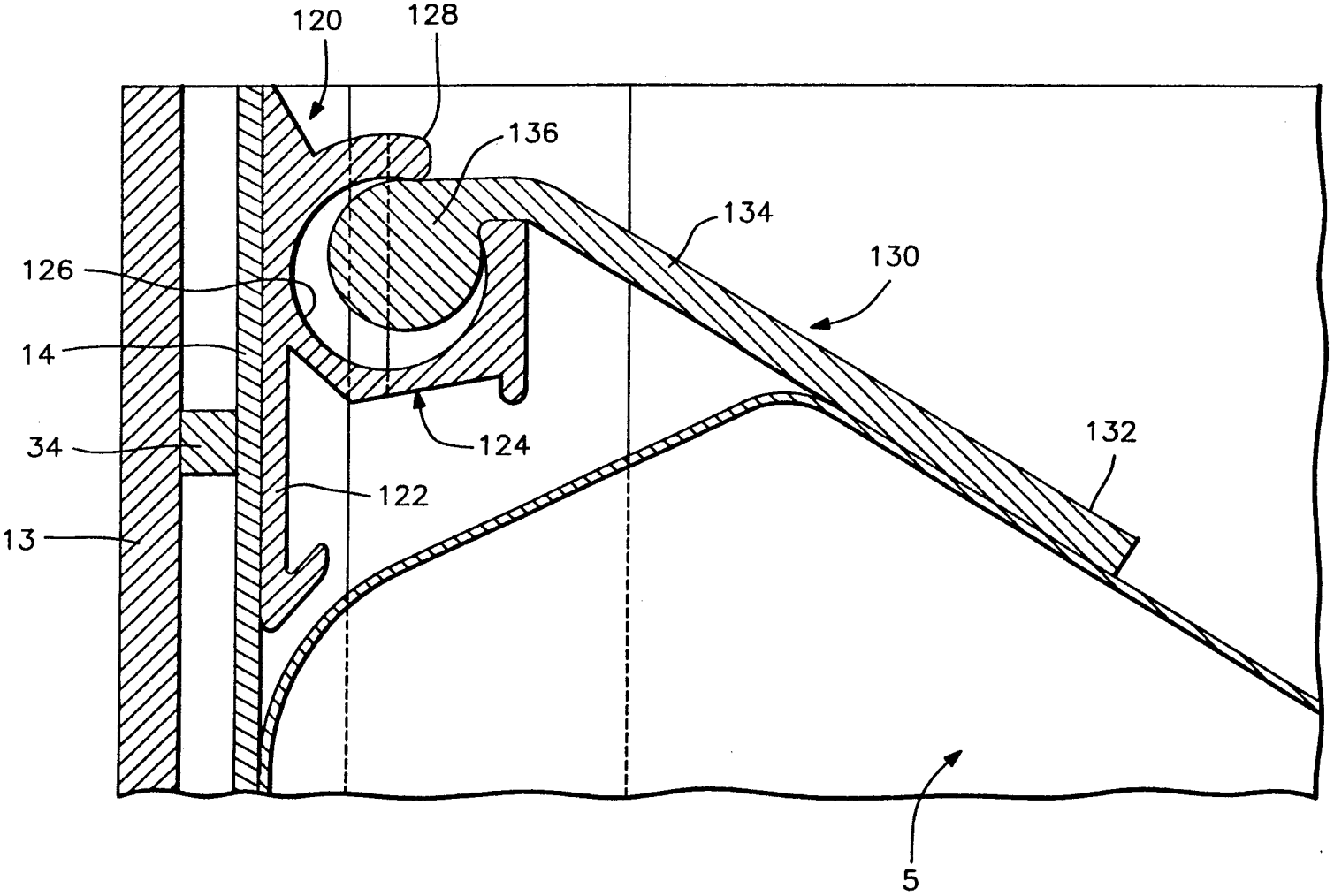
FIG. 2 a portion of the container in an enlarged scale according to FIG. 1.
Figure 7:
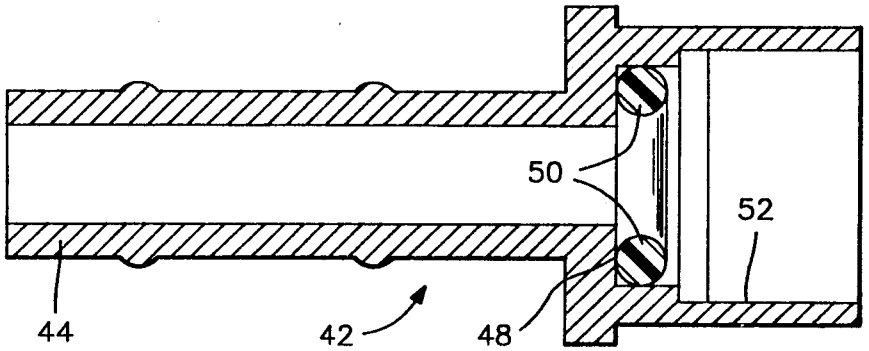
FIG. 7 an axial cross section of the female portion of the valve according to FIG. 4.
Figure 8:
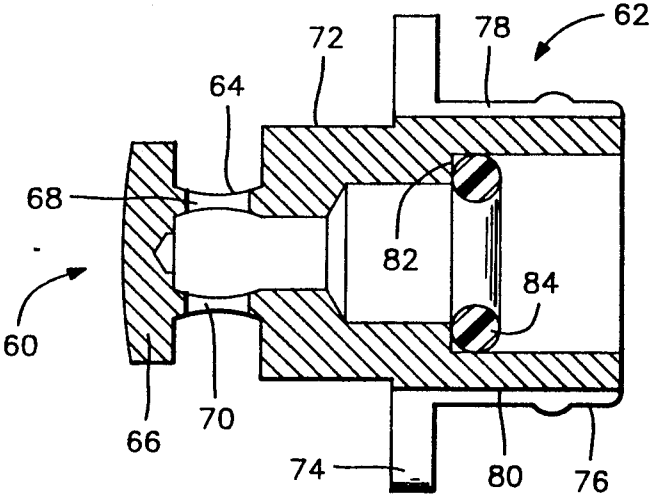
FIG. 8 an axial cross section of the male portion of the valve.
Figure 3:
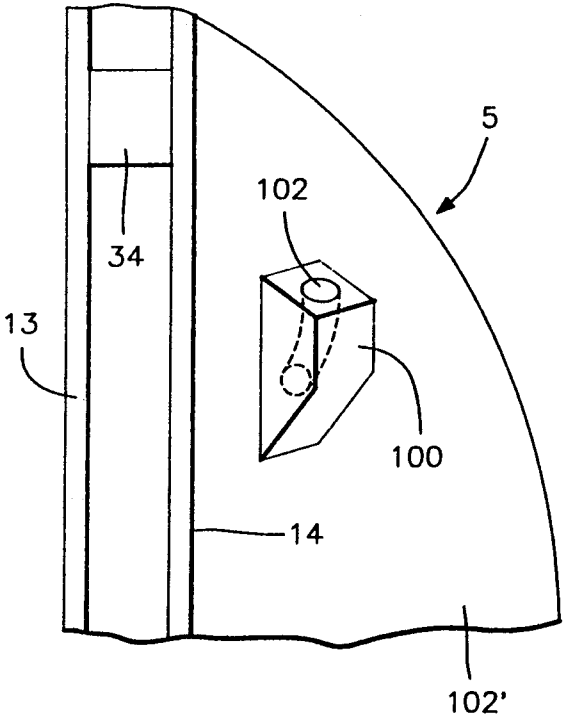
FIG. 3 a detail of the air bag as used in the container according to FIG. 1.
Figure 6:
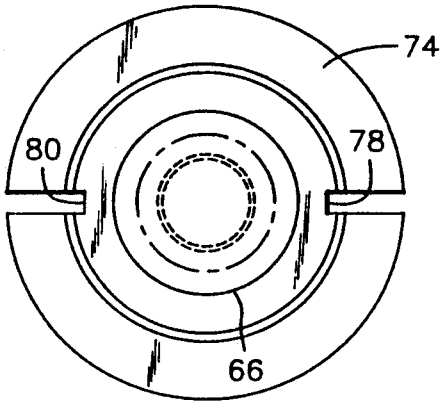
FIG. 6 a front view of the valve according to FIG. 4.
Figure 4:
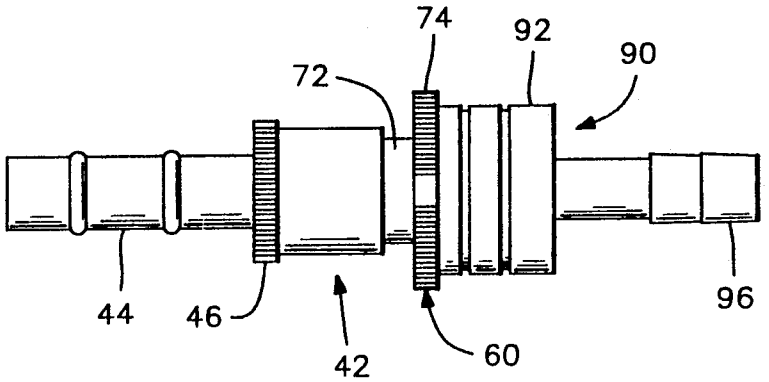
FIG. 4 a plan view of an air bag valve for filling and discharging air.
Figure 5:
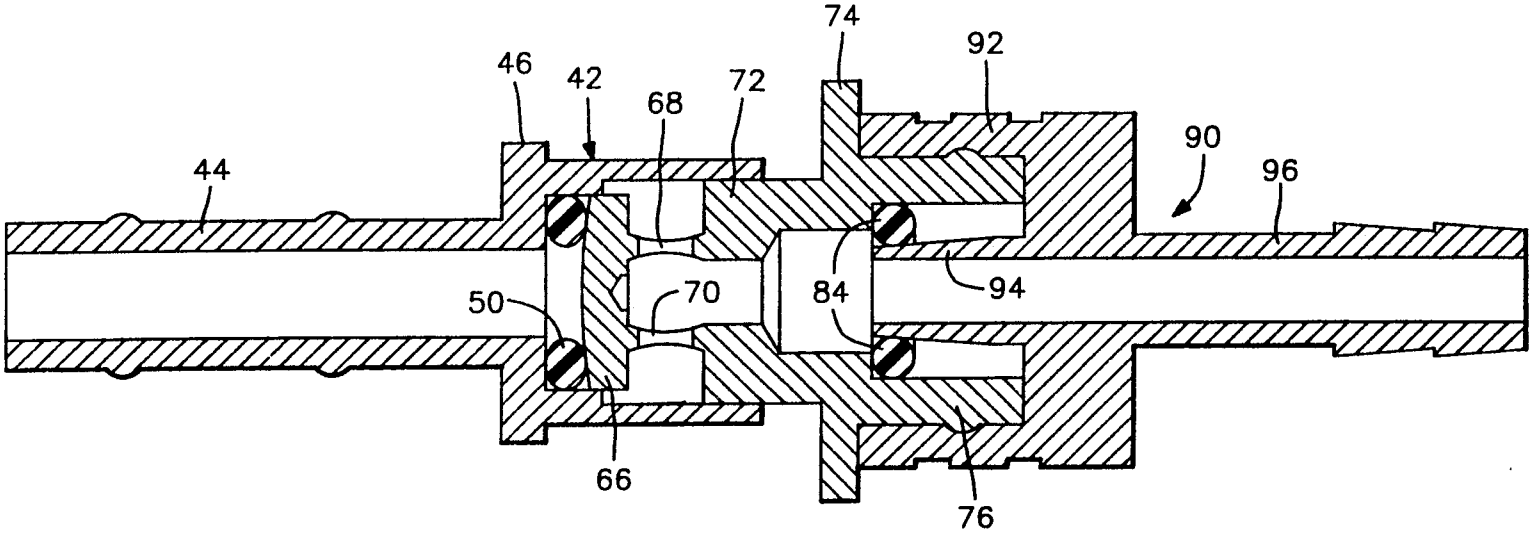
FIG. 5 an axial cross-section of the valve according to FIG. 4.

The compartments associated to the side-walls of the container are, in a preferred embodiment, removably mounted to the inner shells thereof. Instead of utilizing the above mentioned Velcro fasteners unique matching profiles may serve that purpose which are provided on the compartments and the inner shells. According to FIG. 2 an elongated open profile strip 120 of extended light metal or plastic material is fastened to the inner shell 12 along the upper edge thereof. An elongated body 124 surrounding a channel 126 of circular cross section projects from a base 122 which is mounted to the inner shell 12. A longitudinal slot 128 is formed in the upper portion of body 124 through which channel 126 is open to the outside of body 124. Channel 126 communicates with that outside through its opposite open ends and thus forms one of the cooperating profiles for mounting compartment 5 to inner shell 12.

The other one of those profiles is formed from a plastic strip 130 the lower section 132 of which is bonded by an adhesive to the outer surface of an upper portion of compartment 5. Strip 130 projects above the compartment 5 by an elongated portion 134 along the free end of which a cord 136 of circular cross section is formed. Cord 136 is accommodated within channel 126 and may be inserted therein from one of the lateral open ends thereof. The cross section of cord 136 is greater than the width of slot 128 through which the remaining flat body of strip 130 may easily pass. Thus, compartment 5 is held by the cord's 136 being caught within channel 126. Strip 130 is flexible such that its section 132 may easily follow any movements of the compartment web upon inflating or venting the compartment 5.

In the event compartment 5 should have become worn or damaged it may be removed from the container by disconnecting it from hose 19 and shifting core 136 laterally out of channel 126. Thereafter a fresh compartment may be replaced for the removed one.

It is to be understood that every one of the other compartments associated to the side walls are mounted similarly to the adjacent inner shells by cooperating profiles as described hereinbefore.

A product 10 to be shipped by the container according to the invention is fed into the container, the air bag and the compartments 3, 4, 5 and the compartments associated to the not shown rearward wall and the front wall being vented through the open filling valve. The product 10 is placed upon compartment 3. The filling valve is then coupled to a source of pressurized air of about 0.6 bar and all compartments are inflated. The reinforced web portions of the compartments will then engage the periphery of product 10. When the pressure of the air within the compartments has reached the amount of say 0.6 bar further inflating will be stopped by shutting off the filling valve. The filling valve then will be disconnected from the source. This, however, may not be necessary if a small cabinet (not shown) is provided under the cover 6 wherein the source in the form of a small bottle is accommodated. The container then may be closed by securing the cover 6 to the side walls by manipulating the devices 27, 28.

If the compartment 3 is inflatable separatly from the compartments associated to the side walls it is preferred to inflate compartment 3 first before placing the product 10 upon it.

Last but not least it may be understood that it is not intended to limit the scope of the invention by details of the described and shown embodiments thereof.

I claim:

1. A transport container comprising:

side walls, a bottom wall and a cover, said side walls, said bottom and said cover having a two shell construction including an outer shell, an inner shell and spacer elements located between said outer shell and said inner shell at selected locations between said outer shell and said inner shell so as to provide gaps between said outer shell and said inner shell, an inflatable air bag abutting said inner shells, an elasticity of a combination including said inner shells and said spacer elements being selected to have an elasticity greater than said outer shells so that an increase in pressure of a gas in said air bag when said air bag is inflated causes deformation of at least one of said inner shells and said spacer elements so that one of said inner shells and said spacer elements moves substantially independent of said outer shells and transversely to said outer shells.

2. A transport box as defined in claim 1, wherein the air bas has a number of inflatable compartments, each compartment being associated with one of the side walls and abutting the inner shell of the associated side wall.

3. A transport box as defined in claim 2, wherein each compartment is formed from a rubberlike web, the outer surface thereof being reinforced by a wear resistant coating.

4. A transport box as defined in claim 3, wherein the interiors of the compartments communicate with each other.

5. A transport box as defined in claim 2, wherein the interiors of the compartments communicate with each other.

6. A transport box as defined in claim 5, wherein the compartments are removably mounted to the inner shells of the associated side walls.

7. A transport box as defined in claim 6, wherein each compartment is mounted to the inner shell of the associated side wall by two cooperating profiles one of which is mounted to the inner shell and the other one of which is bonded to the web of the compartment.

8. A transport box as defined in claim 5, wherein a filling valve is provided which is adapted to be coupled to one of the compartments and which includes a security lock adapted to prevent unauthorized use.

9. A transport bow as defined in claim 2, wherein the compartments are removably mounted to the inner shells of the associated side walls.

10. A transport box as defined in claim 9, wherein each compartment is mounted by the inner shell of the associated side wall by two cooperating profiles one of which is mounted to the inner shell and the other one of which is bonded to the web of the compartment.

11. A transport box as defined in claim 2, wherein the spacer elements are fastened to the inner shells in the vicinity of the edges thereof.

12. A transport box as defined in claim 2, wherein a separate inflatable air bag is associated with the bottom wall and communicates with the interiors of the compartments, the bottom wall being formed as an outer shell and an inner shell and intermediate spacer elements.

13. A transport box as defined in claim 12, wherein a further separate inflatable air bag is associated with the cover which is hinged to one of the side walls and is formed as an outer shell and an inner shell and intermediate spacer elements, the further air bag communicating with the compartments.

14. A transport box as defined in claim 1, wherein the spacer elements are fastened to the inner shells in the vicinity of the edges thereof.

15. A transport box as defined in claim 1, wherein a separate inflatable air bag is associated with the bottom wall which is formed as an outer shell and an inner shell and intermediate spacer elements.

16. A transport box as defined in claim 15, wherein a further separate inflatable air bag is associated with the cover which is formed as an outer shell and an inner shell and intermediate spacer elements.

17. A transport box as defined in claim 1, wherein a further separate inflatable air bag is associated with the cover which is formed as an outer shell and an inner shell and intermediate spacer elements.

18. A transport box as defined in claim 1, wherein a filling valve is provided which is adapted to be coupled to the air bag and which includes a security lock adapted to prevent unauthorized use.

19. A transport box as defined in claim 18, wherein the filling valve comprises a female body and a male body which are adapted to be screwed into each other for shutting off and opening the valve.

20. A transport box as defined in claim 18, wherein the filling valve has a mouth portion adapted to be coupled to a source of pressurized air, the mouth portion having at least one groove for establishing a leakage way for the air in the event an unauthorized attempt to fill the air bag.

21. A transport box as defined in claim 18, wherein the cover is provided with a cabinet for accommodating a source of pressurized air which is adapted to be coupled to the filling valve.

22. A transport box as defined in claim 1, wherein the cover is provided with a cabinet for accommodating a source of pressurized air adapted to be coupled to the air bag.

* * * * *